US005651489A

United States Patent [19]

Janssen et al.

[11] Patent Number: 5,651,489

[45] Date of Patent: Jul. 29, 1997

[54] FASTENING ELEMENT SETTING TOOL

[75] Inventors: Rupert Janssen, Meiningen, Austria; Luc Guillon, Sax, Switzerland; Markus Froewis, Munich, Germany

[73] Assignee: Hilti Aktiengesellschaft, Schaam, Liechtenstein

[21] Appl. No.: 527,910

[22] Filed: Sep. 14, 1995

[30] Foreign Application Priority Data

Sep. 20, 1994 [DE] Germany ..... 44 33 410.9

[51] Int. Cl.[6] ..... B25C 1/14

[52] U.S. Cl. ..... 227/10; 227/119

[58] Field of Search ..... 227/9, 10, 11, 227/119

[56] References Cited

U.S. PATENT DOCUMENTS

| | | | |
|---|---|---|---|
| 3,776,443 | 12/1973 | Oefinger . | |
| 3,804,314 | 4/1974 | Gilbert | 227/10 |
| 4,196,834 | 4/1980 | Beton | 227/10 |
| 4,239,143 | 12/1980 | Johnson . | |
| 4,684,050 | 8/1987 | Masas | 227/10 |
| 4,711,385 | 12/1987 | Jochum | 227/10 |
| 4,824,003 | 4/1989 | Almeras et al. | 227/10 |
| 5,170,922 | 12/1992 | Ehmig et al. | 227/10 |

FOREIGN PATENT DOCUMENTS

| | | |
|---|---|---|
| 0567370 | 10/1993 | European Pat. Off. . |
| 1808704 | 11/1970 | Germany . |
| 2549196 | 6/1976 | Germany . |
| 2850273 | 5/1980 | Germany . |

*Primary Examiner*—Scott A. Smith

*Attorney, Agent, or Firm*—Anderson Kill & Olick P.C.

[57] ABSTRACT

A fastening element setting tool includes a housing (1), an axially displaceable guide sleeve (2) located within the housing, a bolt guide (3) extending forwardly from the guide sleeve, and a receiving sleeve (4) partially laterally enclosing and axially displaceable relative to the bolt guide (3). The receiving sleeve (4) and the bolt guide (3) are telescopically displaceable relative to one another by an amount in the range of 3 to 5 times the outside diameter of the bolt guide. A protective sleeve (5) at least partially laterally encloses and is axially displaceable relative to the receiving sleeve (4). In the course of its axial displacement relative to the receiving sleeve (4), the protective sleeve (5) strikes against a leading end face (1*a*) of the housing (1) and prevents the full displacement of the guide sleeve (2) into a position ready for ignition of the tool.

7 Claims, 3 Drawing Sheets

FASTENING ELEMENT SETTING TOOL

BACKGROUND OF THE INVENTION

The present invention is directed to a fastening element setting tool including a guide sleeve axially displaceable for a limited extent relative to a housing. A bolt guide is arranged coaxially with and forwardly in the driving or setting direction relative to the guide sleeve. A receiving sleeve is axially displaceable to a limited extent relative to and at least partially laterally encloses the bolt guide. The receiving sleeve has a stop face directed in the setting direction and it cooperates with a stop face on the bolt guide for axially limiting the displacement of the receiving sleeve in the setting direction. Further, the receiving sleeve has a stop face directed opposite to the setting direction and cooperating with a stop face directed in the setting direction for axially limiting the displacement of the receiving sleeve opposite to the setting direction.

Fastening element setting tools of the above type are operated by igniting explosive powder or propellant charges introduced into the setting tool. When the propellant charge is ignited a displacing force acts on a piston within the tool, and the piston, in turn, acts upon the fastening element to be driven into a surface of a structural member. The fastening element is supported in a fastening element or bolt guide in known fastening element setting tools and the bolt guide is disposed coaxially to a guide sleeve and is axially displaceable to a limited extent relative to the housing of the setting tool so that it can be positioned ready for ignition. The guide sleeve serves to receive the piston.

When the propellant charge is ignited the gases generated act on the piston and the fastening element and a rebound or recoil occurs acting opposite to the setting direction due to the explosive gas pressure expanding in all directions. Such rebound can be easily absorbed by the operator of the fastening elements tool, however, a momentary lift-off of the setting tool along with the bolt guide takes place relative to the structural member into which the fastening element is driven. The lift-off of the fastening element setting tool acts opposite to the contact pressure force exerted by the operator, so that immediately after the temporary lift-off, the setting tool with its bolt guide again strikes the surface into which the fastening element is driven. Depending on the attention of the operator, such impact can act on the driven fastening element or on the surface around the fastening element.

The resulting impact can cause disadvantages depending on the character of the surface into which the fastening element is driven, for instance, the surface can be damaged or it can be marked in an unsightly manner. Such impact can be particularly troublesome if sensitive parts are to be secured to the surface, for instance, cable channels or conduits formed of a plastics material. If the fastening element setting tool with its bolt guide strikes a cable channel or a similar plastics part, damage can be caused by cracking which may result in an unserviceable part.

To prevent damage to the surfaces of structural members receiving the fastening elements, the setting tools have so-called surface concrete devices involving an inert mass displaceable relative to the bolt guide. Such a fastening element setting tool is disclosed in DE-PS 25 49 196. In such an arrangement, a guide sleeve is supported in a housing so as to be axially displaceable to a limited extent with a coaxially arranged bolt guide projecting in the setting direction outwardly from the guide sleeve. The surface concrete device in the form of a receiving sleeve partially encloses the bolt guide and it is axially displaceable to a limited extent. A shank screw serves for limiting the axial displaceability of the receiving sleeve with the screw extending into a longitudinally extended groove in the bolt guide for forming stops. The stops are arranged so that the leading end face of the receiving sleeve can be displaced opposite to the setting direction beyond the leading end face of the guide. The stops assure that in the setting direction the leading end face of the receiving sleeve projects slightly beyond the leading end face of the bolt guide.

This known arrangement only partially protects the surface of the structural members or components into which the fastening element is driven, that is, only with the known effects of the surface concrete devices. It is possible, however, that a sideways or transverse displacement of the setting tool along with its bolt guide may take place which is not counteracted by this known solution.

SUMMARY OF THE INVENTION

Therefore, the primary object of the present invention is to provide a fastening element setting tool which avoids any sliding off of the tool with subsequent impingement which could damage the surface of the structural member into which the fastening element is driven or damage to any parts of components being attached to the surface.

In accordance with the present invention, the leading end face of the receiving sleeve projects axially outwardly from the leading end face of the bolt guide when the stop face of the receiving sleeve facing opposite the setting direction rests at a cooperating stop face directed in the setting direction.

An increased length of the setting tool is gained by the telescoping action between the bolt and the receiving sleeve. When the setting tool is lifted off the surface receiving the fastening element by the recoil, the receiving sleeve is displaced in the setting direction relative to the bolt guide, whereby the fastening element setting tool is displaced. After the setting tool has reached its maximum lift-off height from the surface of the structural component, the setting tool rebounds in the direction of the surface. Accordingly, the receiving sleeve and the bolt guide are pushed together. Due to the telescopic arrangement of the receiving sleeve and the bolt guide, the setting tool is guided. As a result, lateral displacement of the setting tool, from the point where the fastening element is driven in, is prevented. The energy developed in the rebound setting tool against the surface receiving the fastening element is dissipated at the original point where the fastening element is driven in. Accordingly, damage of the type described above is prevented.

To drive fastening elements having a greater length in the region of the leading end face of the receiving tool, where at least a portion of the fastening elements projects into the central bore of the receiving sleeve, the leading end face of the receiving sleeve preferably projects beyond the leading end face of the bolt guide.

Since the leading end face of the receiving sleeve extends outwardly from the leading end face of the bolt guide, the stop face of the bolt guide facing in the setting direction is formed for manufacturing reasons advantageously by a leading end face of the bolt guide.

For the same manufacturing reasons, the stop face of the receiving sleeve directed opposite to the setting direction is formed by a shoulder protruding into the projection plane of the leading end face of the bolt guide.

Since the axial displacement of the receiving sleeve relative to the bolt guide must be greater than the lift-off height of the fastening element setting tool from the surface of the structural member into which the fastening element is driven as caused by the force of the rebound, the greatest possible spacing between the leading end face of the bolt guide and the shoulder or stop face of the receiving sleeve facing opposite the setting direction is in the range of three to five times the outside diameter of the bolt guide.

Fastening element setting tools are equipped with a safety device, so that a contact pressure must be developed before a fastening element setting operation can be effected in which the guide sleeve within the housing must be displaced into a position ready for ignition. To prevent the receiving sleeve cooperating with the guide sleeve from being gripped externally and displaced opposite to the setting direction, preferably the receiving sleeve is at least partially enclosed by an axially displaceable protective sleeve which has a stop shoulder directed opposite to the setting direction and cooperating with a leading end face of the housing.

A contact pressure force must be applied to the fastening element setting tool, so that the guide sleeve of the setting tool can be displaced opposite to the setting direction into a position ready for ignition. During such displacement there is an axial displacement of the receiving sleeve and of the guide sleeve. Care must be taken that the protective sleeve or the length of the protective caps forming the protective sleeve is not excessively large whereby an adequate axially displacement can take place. Therefore, the spacing measured between the leading end face of the housing and the leading end face of the receiving sleeve is preferably larger than the spacing between the stop shoulder of the protective sleeve and its leading end face.

To develop increased friction between the leading end region of the receiving sleeve in a receiving bore of a component to be attached, advantageously, the receiving sleeve has in its leading end region an element for increasing friction against the component surface.

Preferably, for economic as well as installation reasons, the element increasing the friction is formed of a rubber elastic ring.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
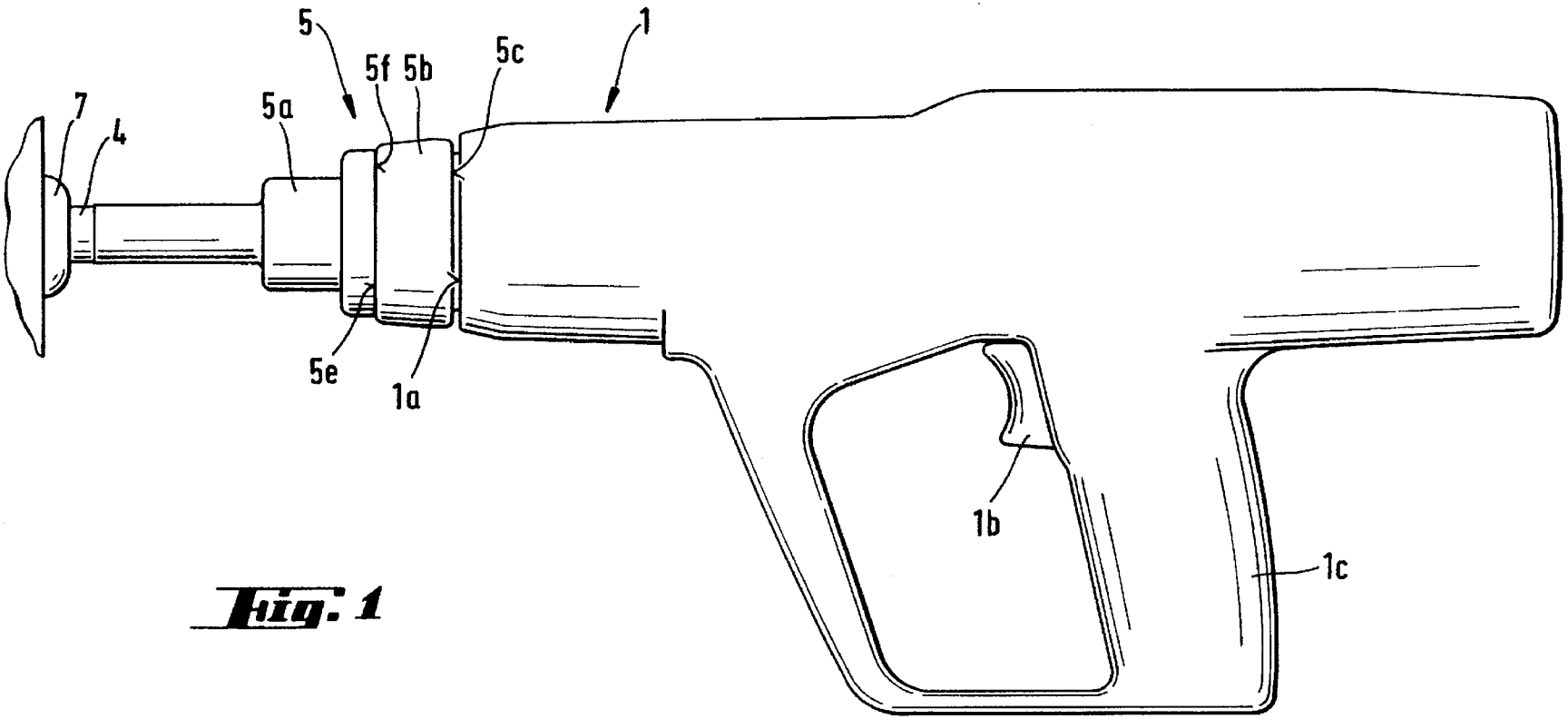
FIG. 1 is a side elevational view of a fastening element setting tool embodying the present invention and shown schematically.

In FIG. 1 a fastening element setting tool is shown schematically including a housing 1 with a handle 1*c* extending downwardly from the housing adjacent its trailing end. The handle is equipped with a manually operated trigger 1*b*.

Figure 2:
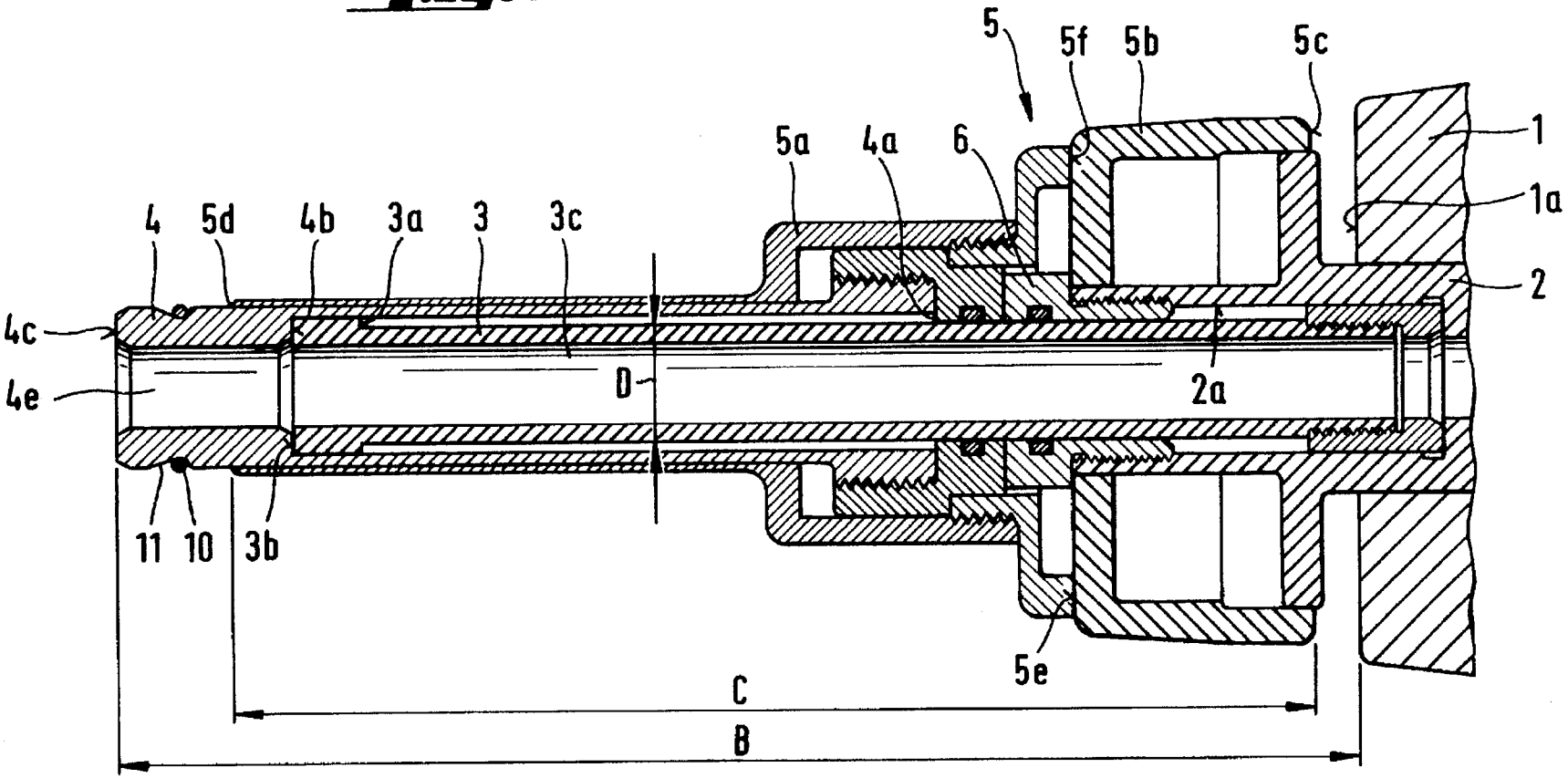
FIG. 2 is an enlarged axially extending cross-sectional view of the leading end region of the fastening element setting tool illustrated in FIG. 1 and shown in the telescoped state.
Figure 3:
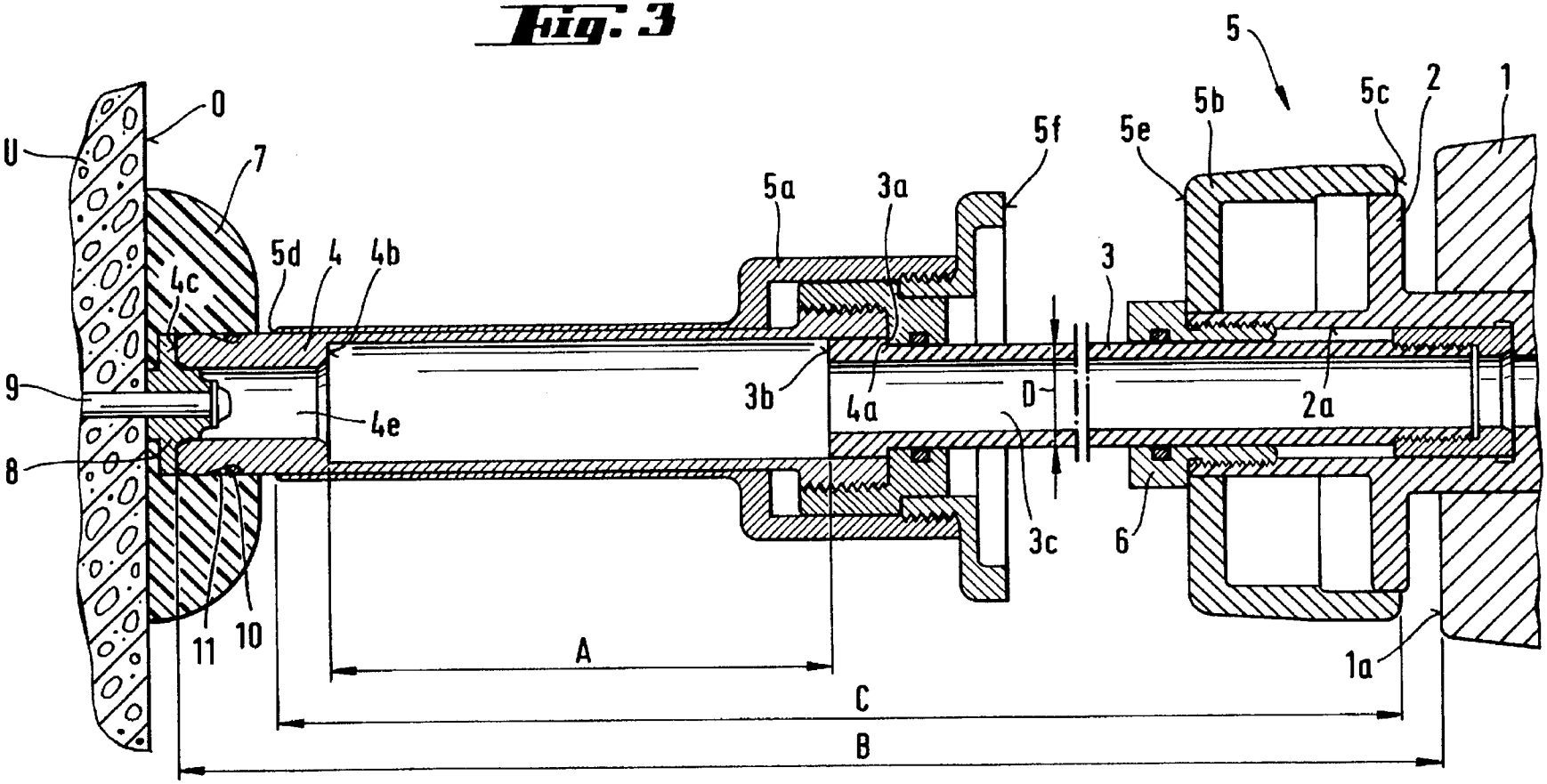
FIG. 3 is an enlarged axially extending sectional view of the leading end region of the fastening element setting tool illustrated in FIG. 1 and shown in the extended state.

As viewed in FIGS. 1, 2 and 3 the housing 1 and the other parts forming the fastening element setting tool each have a leading end and a trailing end with the leading end located to the left in the drawing and the trailing end located to the right. The tool has a setting direction extending from the trailing end to the leading end, accordingly, fastening elements are propelled out of the tool at the left hand end as viewed in FIG. 1.

As shown in FIGS. 2 and 3 a receiving sleeve 4 is at least partially laterally enclosed in the leading end region by an axially displaceable protective sleeve 5. As shown in FIG. 3, the leading end face 4*c* of the receiving sleeve 4 extends into a component 7 bearing against a surface O of a structural member or support surface U.

The leading end region of the fastening element setting tool shown in FIGS. 2 and 3 displays the telescopic displaceability of the receiving sleeve 4 relative to a bolt guide 3. An axially displaceable guide sleeve 2 is located within the housing 1 and the leading end of the guide sleeve 2 projects beyond the leading end face 1*a* of the housing 1. To operate the setting tool by actuating the trigger 1*b* shown in FIG. 1, the guide sleeve 2 must be axially displaced opposite to the setting direction, that is, towards the trailing end of the housing, so that the guide sleeve 2 moves into position ready to propel a fastening element. In this position, the ignition mechanism, not shown in detail, is actuated by the trigger 1*b*.

The axially elongated bolt guide 3 extends at its trailing end into a central receiving bore 2*a* in the guide sleeve 2. The bolt guide 3 is secured against dropping out of the central receiving bore 2*a* by a nut 6 which cooperates by an outside thread disposed on a trailing end projection with an internal thread in the guide sleeve 2. Adjacent its leading end, bolt guide 3 has a stop face 3*a* in the form of a circumferential extending collar facing opposite to the setting direction and serving to limit the displacement of the receiving sleeve 4 in the setting direction. A corresponding stop edge 4*a* is located on the receiving sleeve 4 facing in the setting direction so that it cooperates with the stop face 3*a* on the bolt guide 3.

Bolt guide 3 has an axially extending central through-bore 3*c* and serves for guiding a striker piston, not shown. Further, the bolt guide 3 has a leading end face 3*b* which cooperates with a stop edge or shoulder 4*b* on the receiving sleeve 4 for limiting the axial displacement of the receiving sleeve during its displacement opposite to the setting direction. The shoulder 4*b* is located within the interior of the receiving sleeve 4 and has the shape of a circumferentially extending step. Receiving sleeve 4 has a central bore 4*e* with a diameter corresponding essentially to the diameter of the throughbore 3*c* in the bolt guide 3.

Protective sleeve 5, laterally enclosing the receiving sleeve 4 at least in part, is formed of two axially extending protective caps 5*a*, 5*b*. The protective cap 5*a* has a trailing end face 5*f* facing opposite the setting direction and cooperates with a leading end face 5*e* of the protective cap 5*b* as the protective cap 5*a* is pulled back opposite to the setting direction. Protective cap 5*b* has a trailing end stop shoulder 5*c* facing opposite to the setting direction and can be displaced into contact with a leading end face 1*a* of the housing, when the protective cap 5*b* is displaced counter to the setting direction. Distance B, note FIGS. 2 and 3, measured between the leading end face 1*a* of the housing 1 and the leading end face 4*c* at the receiving sleeve is greater than the distance C located between the trailing end stop shoulder 5*c* and the leading free end 5*d* of the protective sleeve 5, so that the guide sleeve 2 cannot be displaced into its position ready for ignition when the two protective caps 5*a*, 5*b* are pulled back.

The receiving sleeve 4 can be displaced to such an extent in the setting direction relative to the bolt guide 3, whereby the distance A between the leading end face 3*b* of the bolt guide 3 and the shoulder 4*b* of the receiving sleeve 4 is in the range of 3 to 5 times the outside diameter D of the bolt guide 3.

In FIG. 3 the leading end face 4*c* of the receiving sleeve 4 extends into a bore in a component 7. The component 7 carries a thrust washer 8 having an outside diameter corresponding essentially to the outside diameter of the receiving sleeve 4. The thrust washer 8 has an axially extending cylindrical extension projecting opposite to the setting direction at least partially into the central bore 4*e* of the receiving sleeve 4. A fastening element 9, in the form of a nail, extends through the thrust washer 8 into the structural member U. FIG. 3 illustrates the position of the bolt setting tool shortly after the nail 9 has been driven into the structural member and during the lift-off of the bolt setting tool from the surface O of the structure U due to the recoil force. The receiving sleeve 4 is displaced in the setting direction relative to the bolt guide 3. To attain an increased friction for the leading end region of the receiving sleeve 4 in the bore of the component 7, the receiving sleeve 4 has a rubber elastic ring 10 supported in a circumferentially extending recess groove 11 adjacent its leading end face 4*c*. The radial depth of the recess 11 diminishes in the setting direction, that is, towards the leading end face 4*c*, so that a wedge shaped surface is formed in the base of the recess over which the rubber elastic ring 10 is displaceable when an axial displacement of the receiving sleeve 4 occurs opposite to the setting direction relative to the component 7. As a result, as the receiving sleeve is pulled out of the bore in the component 7, the rubber elastic ring 10 is radially compressed affording an increase in friction.

While specific embodiments of the invention have been shown and described in detail to illustrate the inventive principles, it will be understood that the invention may be embodied otherwise without departing from such principles.

We claim:

1. Fastening element setting tool comprising a housing (1) having a trailing end and a leading end and having a fastening element setting direction extending from the trailing end through the leading end, an axially extending guide sleeve (2) positioned within said housing (1) and extending axially in the setting direction from the leading end of the housing, a bolt guide (3) having a leading end and a trailing end and extending axially in the setting direction, said bolt guide (3) extending from said guide sleeve (2) in the setting direction and said trailing end thereof located within said guide sleeve, an axially extending receiving sleeve (4) having a leading end (4*c*) and a trailing end and at least partially laterally enclosing said bolt guide (3) and being displaceable to a limited extent in the axial direction, said receiving sleeve (4) having a first stop edge (4*a*) facing in the setting direction and arranged to cooperate with a first stop face (3*a*) of said bolt guide (3), said receiving sleeve (4) having a second stop edge (4*b*) facing opposite to the setting direction and cooperating with a second stop face (3*b*) of said bolt guide (3) facing in the setting direction for axially limiting displacement of the said receiving sleeve (4) opposite to the setting direction, wherein the improvement comprises that said second stop face (3*b*) of said bolt guide (3) is located at the leading end thereof, and when said second stop edge (4*b*) of said receiving sleeve (4) abuts the second stop face (3*b*) of said bolt guide (3) the leading end (4*c*) of the receiving sleeve (4) is spaced axially in the setting direction from said second stop face (3*b*) of said bolt guide whereby the receiving sleeve (4) forms an axially extending leading end guiding region.

2. Fastening element setting tool, as set forth in claim 1, wherein said second stop edge (4*b*) of said receiving sleeve (4) is formed by a shoulder (4*b*) extending radially inwardly.

3. Fastening element setting tool, as set forth in claim 2, wherein said bolt guide (3) has an outside diameter (D), and the maximum possible distance (A) between said second stop edge (4*b*) of said receiving sleeve (4) and the second stop face (3*b*) of said bolt guide (3) is in the range of 3 to 5 times the outside diameter (D) of said bolt guide (3).

4. Fastening element setting tool, as set forth in claim 1, wherein said receiving sleeve (4) is at least partially laterally enclosed by an axially displaceable protective sleeve (5) having a first stop shoulder (5*c*) at a trailing end thereof and cooperating with a leading end face (1*a*) on said housing (1).

5. Fastening element setting tool, as set forth in claim 4, wherein a distance (B) measured between the leading end face (1*a*) of said housing (1) and the leading end (4*c*) of said receiving sleeve (4) is greater than a distance (C) between the trailing end face (5*c*) of said protective sleeve (5) and a leading end face (5*d*) of said protective sleeve (5).

6. Fastening element setting tool, as set forth in claim 1, wherein said receiving sleeve (4) has an element (10) adjacent the leading end thereof for increasing friction at an outer surface of said receiving sleeve adjacent said leading end.

7. Fastening element setting tool, as set forth in claim 6, wherein said element (10) comprises a rubber elastic ring (10).

* * * * *